US007182108B2

(12) United States Patent
Williamson

(10) Patent No.: US 7,182,108 B2
(45) Date of Patent: Feb. 27, 2007

(54) AUTOMATIC BLEED VALVE FOR PRESSURIZED SYSTEM

(75) Inventor: Larry H. Williamson, Gaviota, CA (US)

(73) Assignee: Submersible Systems, Inc., Huntington Beach, CA (US)

( * ) Notice: Subject to any disclaimer, the term of this patent is extended or adjusted under 35 U.S.C. 154(b) by 236 days.

(21) Appl. No.: 10/878,594

(22) Filed: Jun. 28, 2004

(65) Prior Publication Data

US 2005/0067047 A1 Mar. 31, 2005

Related U.S. Application Data

(60) Provisional application No. 60/507,265, filed on Sep. 30, 2003.

(51) Int. Cl.
*B65B 1/04* (2006.01)

(52) U.S. Cl. ..... 141/20; 141/301; 141/349; 251/148; 251/149.7

(58) Field of Classification Search ..... 141/18, 141/20, 383, 386, 67, 301, 302, 347–351; 251/148, 149.7

See application file for complete search history.

(56) References Cited

U.S. PATENT DOCUMENTS 4,293,009 A * 10/1981 Fulton ..... 141/311 R
5,960,841 A * 10/1999 Green ..... 141/383
6,390,158 B2 * 5/2002 Johnston ..... 141/383
6,837,270 B2 * 1/2005 Douglas et al. ..... 137/613

* cited by examiner

*Primary Examiner*—Steven O. Douglas
(74) *Attorney, Agent, or Firm*—Knobbe, Martens, Olson & Bear LLP

(57) ABSTRACT

An apparatus and method is provided for automatically venting a fluid from at least a portion of a pressurized system. An interconnection between two devices in the system contains an automatic bleed valve configured to automatically seal a vent hole when the two devices are coupled together and to automatically unseal the vent hole before the two devices are separated. In an embodiment, an adapter includes a ring that both screws a connector onto a device and seals a vent hole. A pin is pushed into the vent hole as the connector is screwed to the device. To remove the adapter from the device, the ring is turned to both unseal the vent hole and to unscrew the connector from the device. Turning the ring releases the pin before the connector is unscrewed.

10 Claims, 9 Drawing Sheets

MODEL #910C REFILL ADAPTER

Instructions for Filling SPARE AIR from a SCUBA Tank

NOTE: Always refill SPARE AIR immediately after use, so the system is ready for subsequent use

1. Remove black knurled Check Valve Cap from the SPARE AIR Check Valve filling port by turning counter-clockwise.

2. Screw 910C Adapter on to Check Valve until finger tight (do not over tighten). Turn the adapter Bleed Screw clockwise until finger tight.

3. Attach 910C Adapter to SCUBA tank.

CAUTION: DO NOT stand directly over top of SPARE AIR regulator during filling.

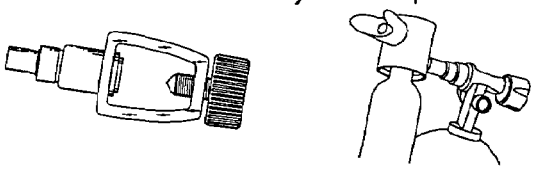

4. Open SCUBA tank very SLOWLY and fill SPARE AIR ( it should take approx. 1 minute). The White Indicator Pin on the unit's Pressure Indicator will rise up while filling. When flush with surface, SPARE AIR is full at 3000 psi.

5. Close SCUBA tank valve.

6. Turn the adapter Bleed Screw a 1/2 turn counter-clockwise to relieve pressure in the adapter. Remove 910C Adapter from SCUBA tank and SPARE AIR.

7. Replace black knurled Check Valve Cap to the SPARE AIR Check Valve.

NOTE: If SCUBA tank WAS NOT FULL at beginning of refill Pressure Indicator will not register full and your SPARE AIR will not be filled to its recommended full capacity, diminishing available air volume.

WARNING: If the SPARE AIR Check Valve or 910C Adapter threads are damaged or worn, these parts require replacement. Continued use may cause injury.

SUBMERSIBLE SYSTEMS, INC.

*FIG. 4*

*(PRIOR ART)*

AUTOMATIC BLEED VALVE FOR PRESSURIZED SYSTEM

CLAIM OF PRIORITY

This application claims the benefit under 35 U.S.C. § 119(e) of U.S. Provisional Application No. 60/507,265, filed on Sep. 30, 2003, which is hereby incorporated by reference.

BACKGROUND

The present invention relates generally to bleed valves used in systems comprising a pressurized fluid. More specifically, the present invention relates to methods and apparatus for automatically venting a portion of a fluid from at least a portion of a pressurized system.

Pressurized systems typically comprise a pressurized fluid, such as a liquid or gas, which is contained within the system at a pressure that is different from the pressure of the environment surrounding the system. A pressurized system may also comprise a valve for venting a portion of the pressurized fluid to change the pressure of the fluid or to equalize the pressure of the fluid of the system with the pressure of the surrounding environment. Such a valve for venting a portion of the pressurized fluid may be referred to herein as a "vent," "bleed valve," "venting valve," or "release valve."

FIG. 1 illustrates an example of a pressurized system 38 comprising a first pressurized device 40 connected to a second pressurized device 42 through a pressurized passage 48. The pressurized passage 48 may be connected to the first pressurized device 40 through a first releasable interface 44 and to the second pressurized device 42 through a second releasable interface 46. The first releasable interface 44 and the second releasable interface 46 may each be configured to prevent the passage of -a fluid (not shown) when closed and to allow the passage of the fluid when opened. When the first releasable interface 44 and second releasable interface 46 are both open, a pressurized fluid may flow between the first pressurized device 40 and the second pressurized device 42 through the pressurized passage 48. For example, if the first pressurized device 40 is at a higher pressure than the second pressurized device 42 when the first releasable interface 44 and second releasable interface 46 are opened, the pressurized fluid will flow from the first pressurized device 40 to the second pressurized device 42 until the relative pressures of the first pressurized device 40 and the second pressurized device 42 are equalized or one of the pressurized interfaces 44, 46 are closed.

By way of example, the pressurized system 38 may be used to fill scuba tanks or other pressurized devices with a compressible fluid. Thus, for example, the first pressurized device 40 may comprise a pressurized air source used to fill or pressurize the second pressurized device 42 which in turn may comprise, for example, a scuba tank. As another example, the first pressurized device 40 may comprise a large scuba tank used to fill a smaller scuba tank (i.e., the second pressurized device 42) with compressed air.

An artisan will recognize that the pressurized system 38 can be adapted to accommodate a wide range of fluid pressures. For example, scuba tanks are typically rated to withstand air pressures ranging from approximately 1800 PSI (i.e., approximately 124 bar) to approximately 3000 PSI (i.e., approximately 206 bar) or higher in the United States. In other countries, scuba tanks are rated to withstand air pressures ranging from approximately 3000 PSI (i.e., approximately 206 bar) to approximately 4500 PSI (i.e., approximately 310 bar).

The pressurized system 38 may also comprise a vent 50 coupled to the pressurized passage 48. The vent 50 may also be coupled to a vent controller 52 configured to manually open and close the vent 50 to alter the pressure of the fluid in at least a portion of the pressurized system 38. For example, if the first releasable interface 44 is closed and the second releasable interface 46 is open, opening the vent 50 with the vent controller 52 will alter the pressure in the passage 48 and the second pressurized device 42. Similarly, if both releasable interfaces 44, 46 are closed, opening the vent 50 will only alter the pressure of the fluid in the passage 48.

FIG. 2 illustrates an adapter 54, such as the model 910C refill adapter available from Submersible Systems, Inc. of Huntington Beach Calif. The adapter 54 comprises a screw 56 and a yoke 58 configured to attach the adapter 54 to a first pressurized device (not shown), such as a scuba tank or other pressurized container. The adapter further comprises a fitting 60 configured to provide a fluid passage from the first pressurized device to a second pressurized device (not shown). The fitting 60 includes a vent hole 62 and a bleed screw 64 configured to open and close the vent hole 62. The bleed screw 64 comprises a threaded stem 67 and a sealing device 68, such as an o-ring or soft seat.

Charging adapters or refill adapters, such as the adapter 54 shown in FIG. 2, typically need a vent or release valve incorporated into their design to relieve the pressure on the fittings. For example, as shown in FIG. 3, the adapter 54 may be threaded onto a regulator 66, such as the "Spare Air" regulator available from Submersible Systems, Inc., located in Huntington Beach, Calif. Typically, when filling a pressurized container (not shown) configured to attach to the regulator 66, the adapter 54 is threaded onto the regulator 66 by the action of fingertips or special tools (not shown). For example, a user can grip the fitting 60 by hand and screw it onto the regulator 66.

When the fitting 60 is not under pressure, screwing it onto the regulator 66 requires overcoming only a small resistance, such as that required to compress an o-ring (not shown). However, to unscrew and remove the adapter 54 from the regulator 66 requires that the fluid pressure be discharged from the fitting 60. Typically, removing the adapter 54 from the regulator 66 involves first turning the bleed screw 64 by hand to release the pressure on the threads of the fitting 60 and then turning the fitting 60 by hand to unscrew it from the regulator 66.

FIG. 4 illustrates instructions for filling a pressurized tank, referred to as "SPARE AIR," from a scuba tank using a refill adapter, such as the adapter 54 shown in FIG. 2. As the instructions indicate, the operation of filling the pressurized tank is complicated by the need to turn two different valves in a particular sequence. In fact, if the instructions are not followed, the act of refilling will not even occur. For example, in normal operations, an operator must first screw the adapter to the corresponding threaded part. This is typically a one-way check valve on the device to be filled. Then, before opening the valve that would allow the gas or fluid to travel from the storage device or fill station, the operator must first be sure to close the vent valve of the adapter to prevent the contents from leaking out the fittings instead of refilling the device. The same problem arises after the device to be recharged is full. After shutting off the main flow control valve from the storage tank or refill station, the operator must now open the vent valve by turning it in the opposite rotation used to close it.

Typically, even experienced operators may make a mistake and not remember to close the vent before starting to fill, or attempt to unscrew it without first relieving the pressure. This would make it very difficult or impossible to unscrew due to the increased pressure load on the threads. This sometimes leads to the operator employing a hammer or large wrench in order to break free what are thought to be slightly stuck threads. In some cases this forcing action can shorten the life-span of the parts or even result in a sudden failure of the parts involved. This can also produce a small explosion of compressed gas that can cause the adapter or pieces thereof to fly through the air, possibly resulting in injury.

Further, the construction of some existing types of vent valves has been prone to easily, yet accidentally, unscrewing the vent valve so much that it is completely removed from the vent hole and lost. Additionally, some existing devices are prone to wear over time and have a tendency to either develop leaks or, even worse, completely fail under pressure, which could lead to serious injury.

Thus, it would be advantageous to develop a technique and device for automatically venting a fluid from a pressurized system to allow an element or component of the system to be safely removed from the system.

SUMMARY

The invention provides methods and apparatus for automatically venting a portion of a fluid from at least a portion of a pressurized system. An embodiment of the invention provides an improved method for refilling pressurized containers. Another embodiment of the invention provides an adapter with an automatic bleed valve for high pressure connections in systems configured to charge or refill lines, cylinders, or other sealed systems. This invention has overcome the stated shortcomings.

When being screwed in place to it's corresponding part such as a check valve, the users fingers are in contact with a knurled raised ring that serves both as a gripping surface to screw the adapter into place and as the housing for an eccentric shaped surface. This exerts force and movement to a moveable pin having a conical end (preferably made of a semi-elastic material such as nylon). The pin then creates a seal with its conical end against an orifice contained in the body of the threaded port of the adapter.

The operator does not need to worry about the action of opening or closing the vent valve because the simple motion of rotating the knurled ring for purposes of screwing the adapter on and off will cause the cam surface (cut into a counter bored surface of the ring) to close and open the vent. In particular, rotating the ring in one direction seats the pin to seal the vent hole and turning the ring in the opposite direction will allow the pin to unseat and thus cause the valve to vent. All of this occurs without the operator's attention. Thus, using a high-pressure refilling device or an adapter between two pressurized devices is simple and safe.

BRIEF DESCRIPTION OF THE DRAWINGS

The drawings, which illustrate what are currently considered to be best modes for carrying out the invention:

FIG. 4 is an illustration of refill instructions employing the adapter of FIG. 2;

DETAILED DESCRIPTION OF THE PREFERRED EMBODIMENT

Figure 1:
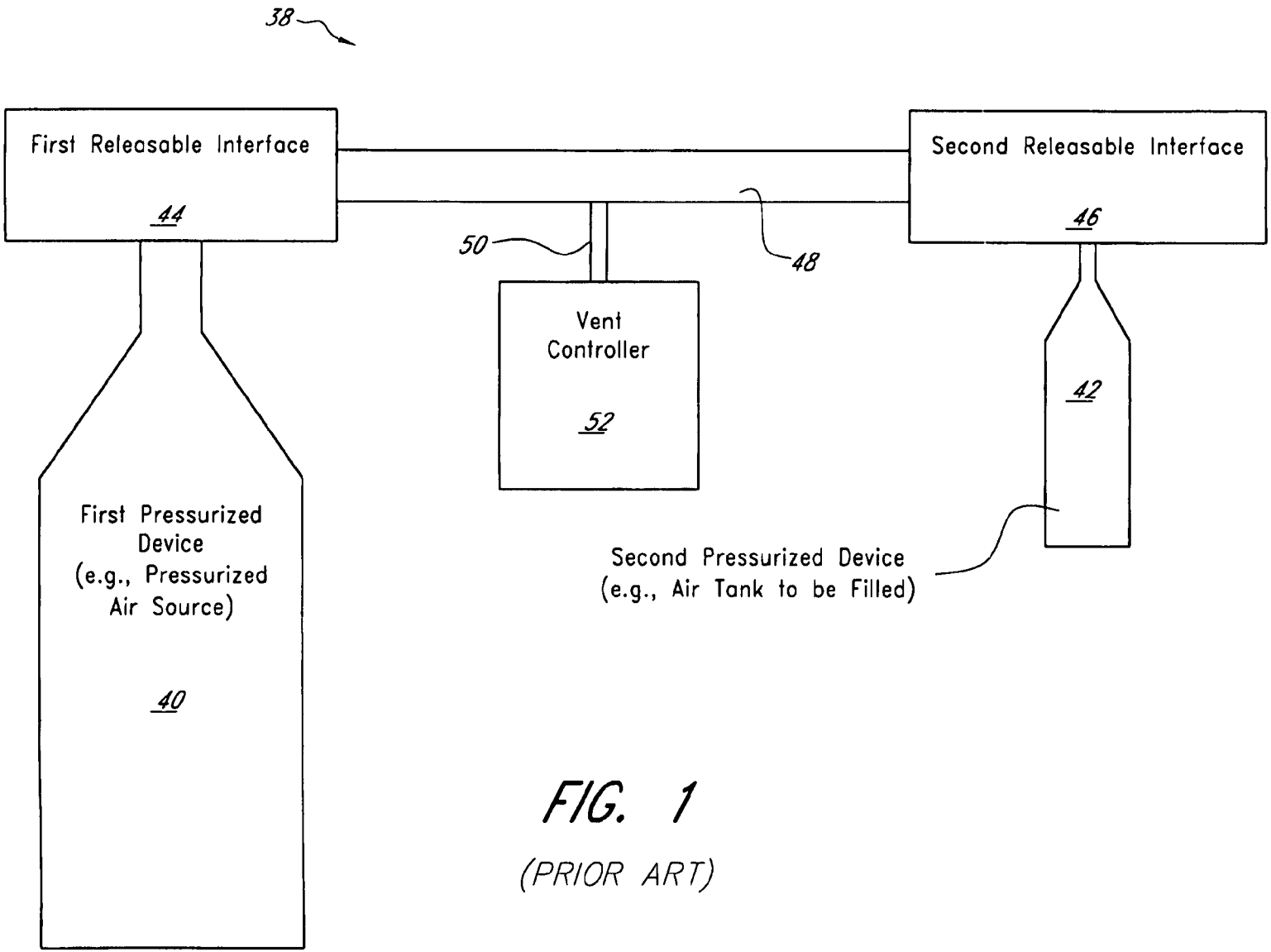
FIG. 1 (PRIOR ART)
FIG. 1 is a block diagram of a pressurized system.
Figure 2:
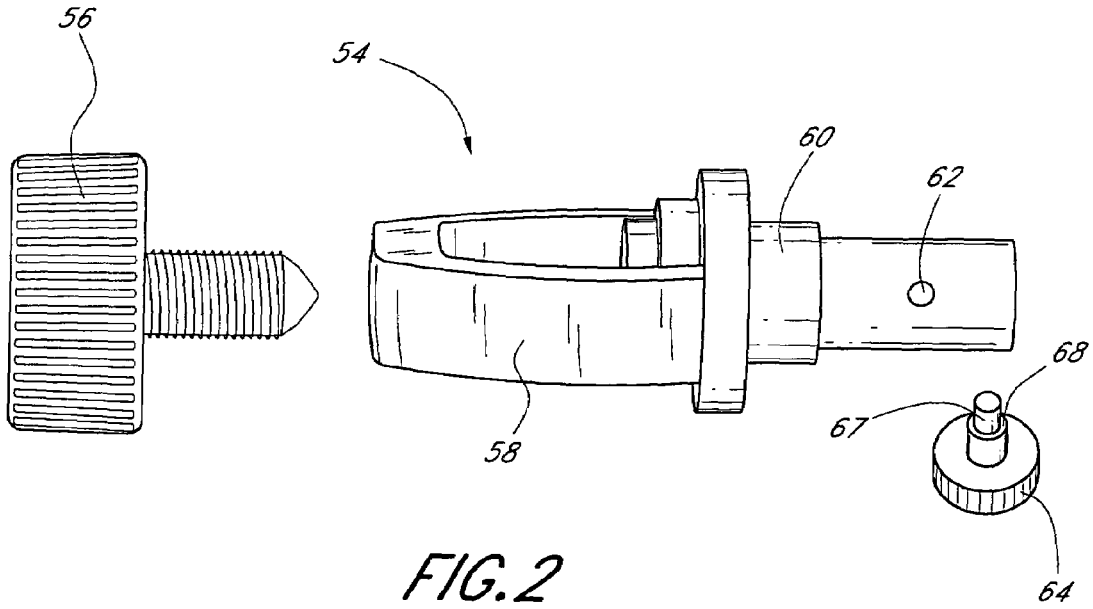
FIG. 2 (PRIOR ART)
FIG. 2 is a photograph of an adapter with a manual bleed screw.
Figure 3:
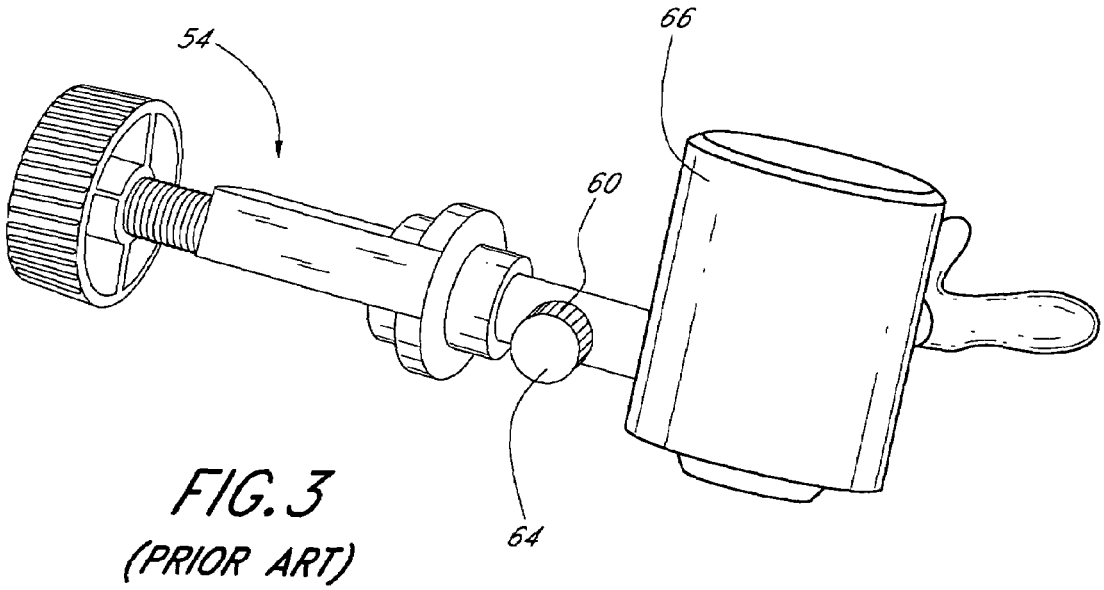
FIG. 3 (PRIOR ART)
FIG. 3 is a photograph of the adapter of FIG. 2 coupled to a regulator.
Figure 5:
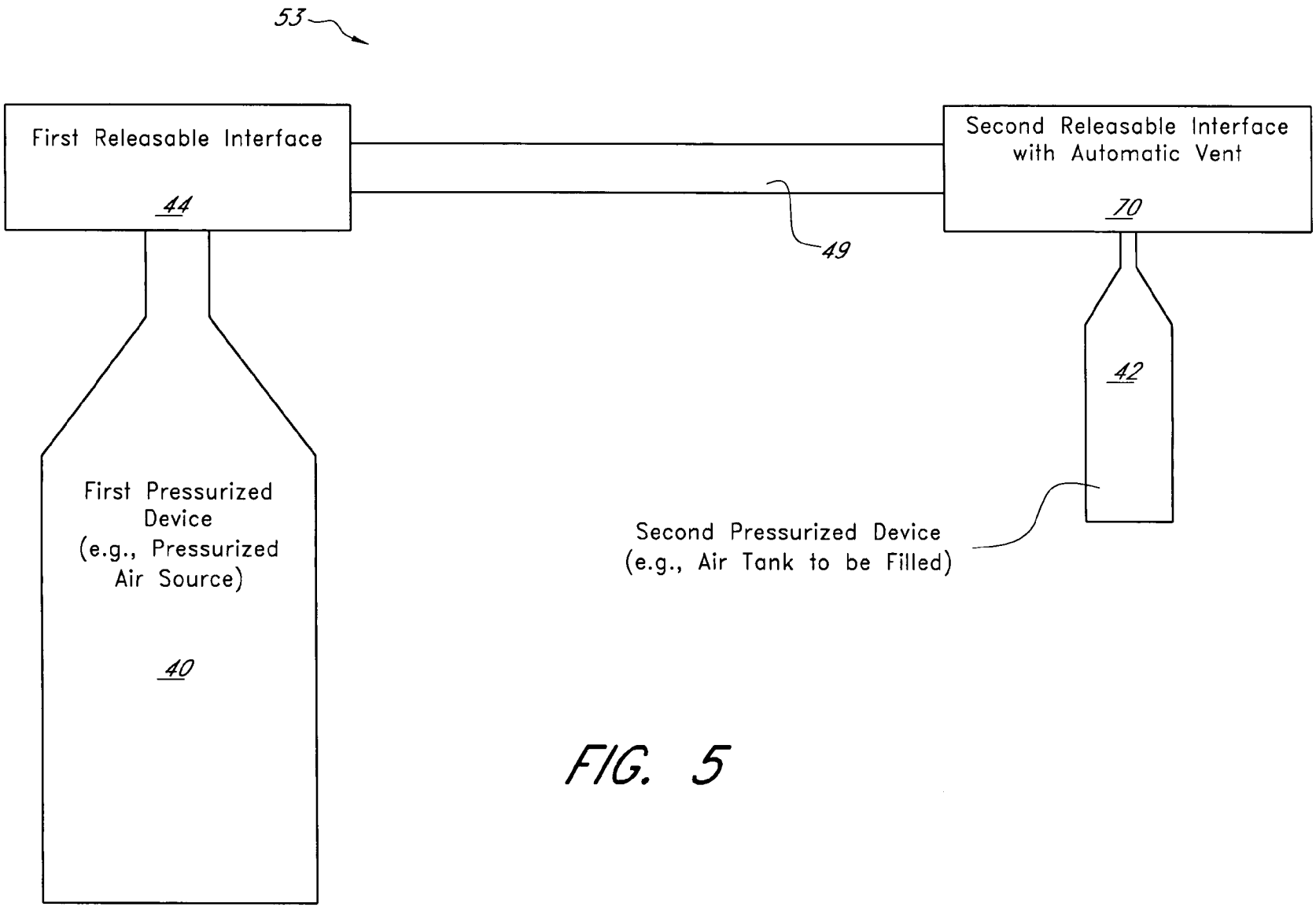
FIG. 5 is a block diagram of a pressurized system with an automatic vent, according to an embodiment of the invention.

FIG. 5 illustrates a block diagram of a pressurized system 53 according to an embodiment of the invention. The pressurized system 53 comprises a first pressurized device 40 configured to be coupled to a second pressurized device 42 through a pressurized passage 49. The pressurized passage 49 is configured to be coupled to the first pressurized device 40 through a first releasable interface 44 and to the second pressurized device 42 through a second interface 70. The second interface 70 comprises an automatic bleed valve (not shown) which is configured to seal a vent hole (not shown) when the second interface 70 is attached to the second pressurized device 42 and to unseal the vent hole before the second interface 70 is detached from the second pressurized device 42.

By way of example, the pressurized system 53 may be used to fill scuba tanks or other pressurized devices with a compressible fluid such as air. Thus, for example, the first pressurized device 40 may comprise a pressurized air source used to fill or pressurize the second pressurized device 42 which in turn may comprise, for example, a scuba tank. As another example, the first pressurized device 40 may comprise a large scuba tank used to fill a smaller scuba tank (i.e., the second pressurized device 42) with compressed air. However, an artisan will recognize from the disclosure herein that the adapter of the present invention may be used to fill scuba tanks of any size and that the relative sizes of the first pressurized device 40 and the second pressurized device 42 are not limiting.

In an exemplary embodiment, the second pressurized device 42 comprises a miniature scuba tank for storing approximately three cubic feet of air and having a length of approximately 13.4 inches, a diameter of approximately 2.25 inches, and a pressure rating of approximately 3000 PSI. In another exemplary embodiment, the second pressurized device 42 comprises a miniature scuba tank for storing approximately 1.7 cubic feet of air and having a length of approximately 8.75 inches, a diameter of approximately 2.25 inches, and a pressure rating of approximately 3000 PSI. An artisan will recognize from the disclosure herein that the pressurized system 53 can be adapted to accommodate a wide range of fluid volumes and pressures.

Figure 6:
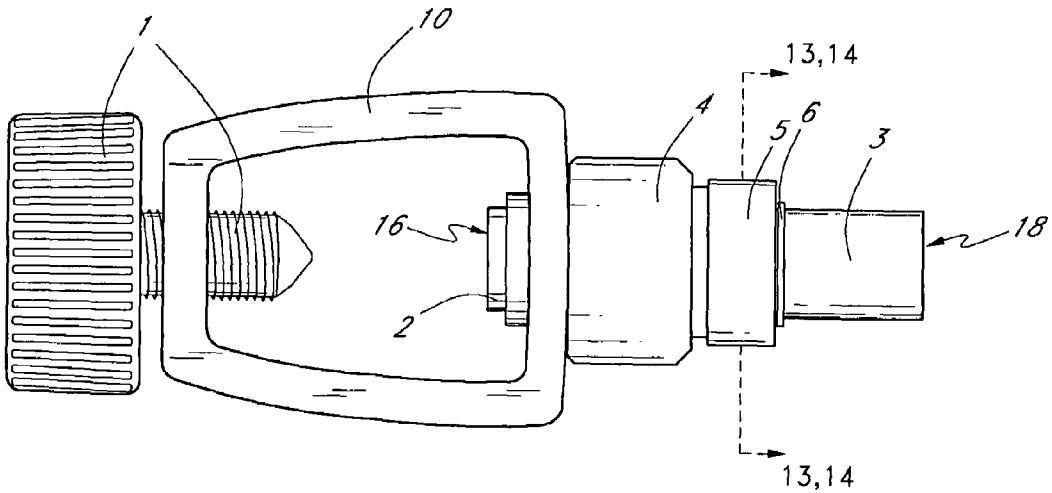
FIG. 6 is a schematic diagram of an adapter assembly with an automatic vent, according to an embodiment of the invention.
Figure 7:
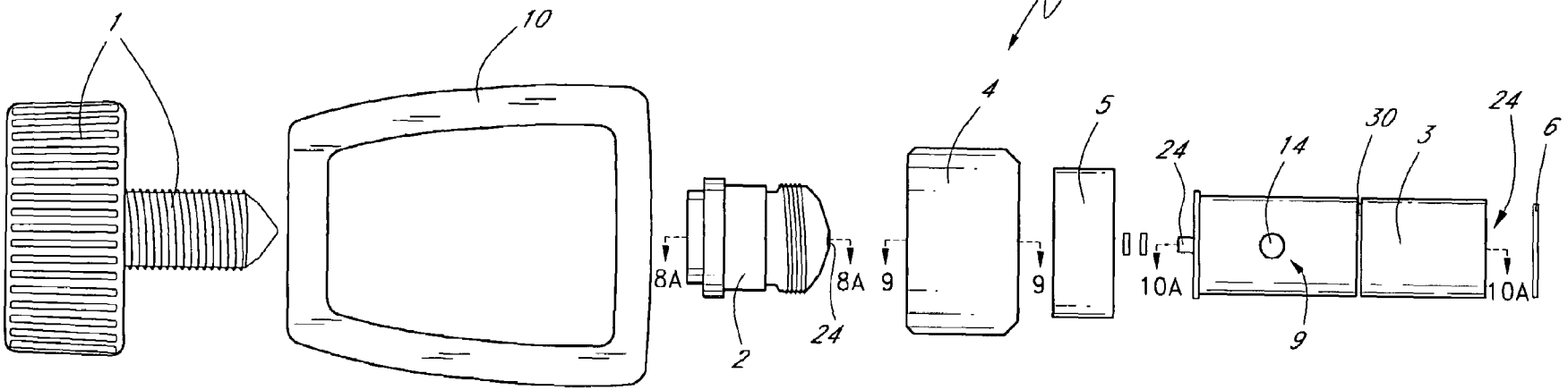
FIG. 7 is a schematic diagram illustrating the interconnection of various components of the adapter assembly shown in FIG. 6, according to an embodiment of the invention.

FIG. 6 is a schematic diagram of an adapter assembly 12 according to an embodiment of the invention. The adapter assembly 12 comprises a screw 1, a yoke 10, an adapter fitting 2, a swivel fitting 3, a swivel nut 4, a ring vent or cam ring 5, and a retaining ring 6. FIG. 7 illustrates the interconnection of various components of the adapter assembly shown in FIG. 6. The adapter fitting 2 and swivel fitting 3 are configured to couple together to form a fluid passage 24 having a first end 16 and a second end 18. As shown in FIG. 7, the swivel fitting 3 comprises a resealable vent 14 configured to release pressure from the fluid passage 24 when unsealed.

The screw 1 and yoke 10 are configured to secure the adapter assembly 12 to a first pressurized device (not shown), such as a scuba tank, so that the adapter fitting 2 may interface with the first pressurized device. The swivel nut 4 is configured to slide over the swivel fitting 3 and to thread onto the adapter fitting 2 to secure the adapter fitting 2 to the swivel fitting 3 and yoke 10. Thus, the swivel nut 4 holds the flange of the adapter fitting 2 firmly against the opening of the yoke 10 while allowing the swivel fitting 3 to rotate. A washer 7 and a seal 8, such as an o-ring, are placed at the interface of the adapter fitting 2 and swivel fitting 3 to allow the swivel fitting 3 to rotate freely while maintaining a pressure seal for the fluid passage 24 between the adapter fitting 2 and the swivel fitting 3. The swivel fitting 3 is configured to interface with a second pressurized device (not shown), such as a miniature scuba tank, at the second end 18 of the fluid passage 24.

In operation, the adapter assembly 12 is configured to automatically seal the vent 14 when attached to the second pressurized device and to automatically unseal the vent 14 before being detached from the second pressurized device. Thus, the adapter assembly 12 can be safely used to transfer fluid in a pressurized system. For example, the adapter assembly 12 shown in FIGS. 6 and 7 can be used to fill a small scuba tank with compressed air from a larger scuba tank. The adapter fitting (not shown) is attached to the scuba tank by the yoke 10 and screw 1. The swivel fitting 3 is attached to a one way check valve (not shown) of a regulator 66 that is attached to the small scuba tank. In an embodiment, the small scuba tank is a "Spare Air" tank available from Submersible Systems, Inc. of Huntington Beach, Calif.

The adapter assembly 12 is attached to the small scuba tank by turning the cam ring 5 which causes the swivel fitting 3 to rotate and thread onto the check valve. As discussed in more detail below, turning the cam ring 5 to attach the adapter assembly 12 to the check valve of the regulator 66 automatically seals a vent hole. Thus, the cam ring 5 is simultaneously used to seal the vent 14 (shown in FIG. 7) and to screw the adapter assembly 12 to the check valve. With the vent sealed, the small scuba tank can then be filled with compressed air from the scuba tank.

After filling the small scuba tank, the adapter 12 is detached from the regulator 66 by turning the same cam ring 5 to unscrew the swivel fitting 3 from the check valve. As discussed in more detail below, turning the cam ring 5 to detach the swivel fitting 3 from the regulator 66 automatically unseals the vent 14 and releases the pressure on the threads of the swivel fitting 3. By continuing to turn the cam ring 5, the swivel fitting 3 is unscrewed from the check valve. Thus, turning the cam ring 5 automatically releases the pressure in the adapter assembly 12 before unscrewing the swivel fitting 3 from the check valve. Although the adapter assembly 12 can be used to fill a small scuba tank with compressed air from a larger scuba tank, an artisan will recognize from the disclosure herein that the invention is not so limited. In fact, the adapter assembly can be used to transfer fluids between pressurized devices regardless of the relative sizes of the devices.

Referring again to FIGS. 6 and 7, the vent 14 in the swivel fitting 3 selectively allows a pressurized fluid (not shown) to flow in or out of the fluid passage 24. The swivel fitting 3 further comprises a moveable pin 9 formed from a semi-elastic material such as nylon configured, sized and positioned in the vent 14 so as to prevent fluid from flowing through the vent 14 when the pin 9 is pressed into the vent 14. An embodiment of the pin 9 is described in greater detail below with respect to FIG. 11. The cam ring 5 is configured to slide over the swivel fitting 3 and the vent 14. The cam ring 5 is held in place with the retaining ring 6 positioned in slot 30 so that the cam ring 5 is allowed to rotate over the swivel fitting 3. As will be discussed in more detail below, the cam ring 5 is configured to press down on the pin 9 as it is rotated over the swivel fitting 3.

The attached Appendix includes a presentation with photographs and text demonstrating a use of the adapter assembly according to an embodiment of the invention. The Appendix forms a part of the application.

Figure 8:
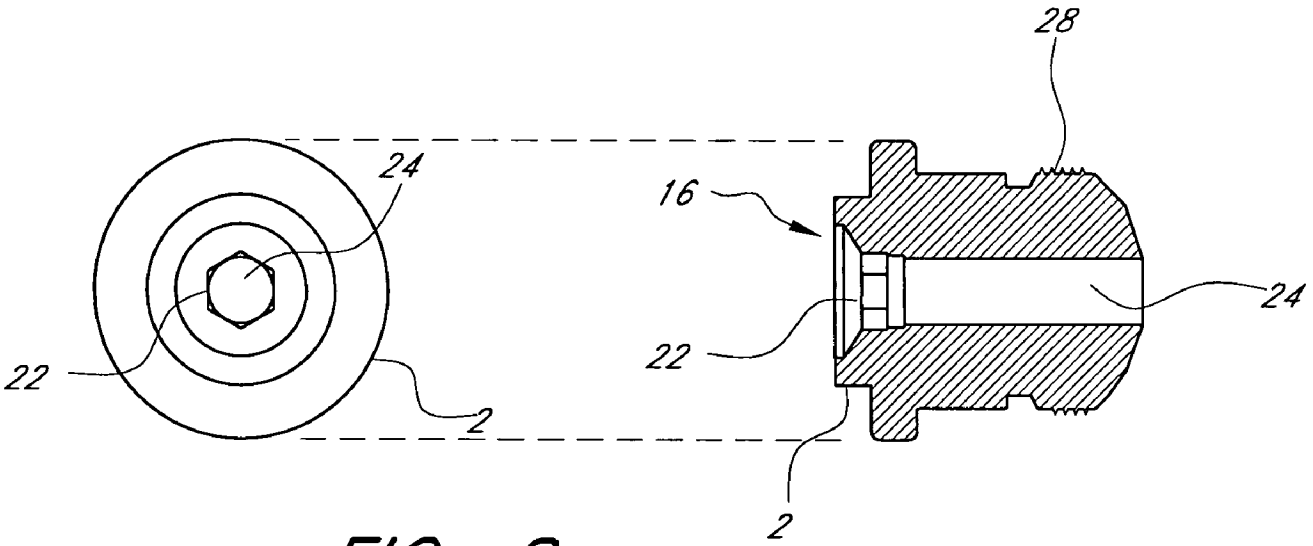
FIG. 8 is a detailed schematic of the adapter fitting shown in FIG. 7, according to an embodiment of the invention.

FIG. 8 is a detailed schematic of the adapter fitting 2 shown in FIG. 7, according to an embodiment of the invention. The adapter fitting 2 comprises an adapter interface 22 configured to engage a first pressurized device (not shown) and to allow a fluid (not shown) to pass between the first pressurized device and the first end 16 of the fluid passage 24.

Figure 9:
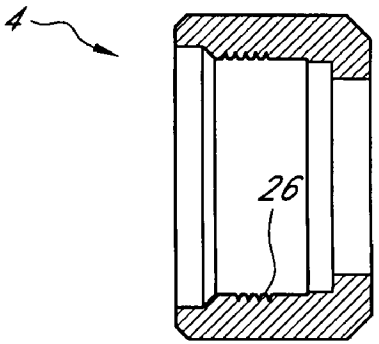
FIG. 9 is a detailed schematic of the swivel nut shown in FIG. 7, according to an embodiment of the invention.

FIG. 9 is a detailed schematic of the swivel nut 4 shown in FIG. 7, according to an embodiment of the invention. The swivel nut 4 may comprise internal screw threads 26 configured to engage the threads of the adapter fitting 2 shown in FIG. 7.

Figure 10:
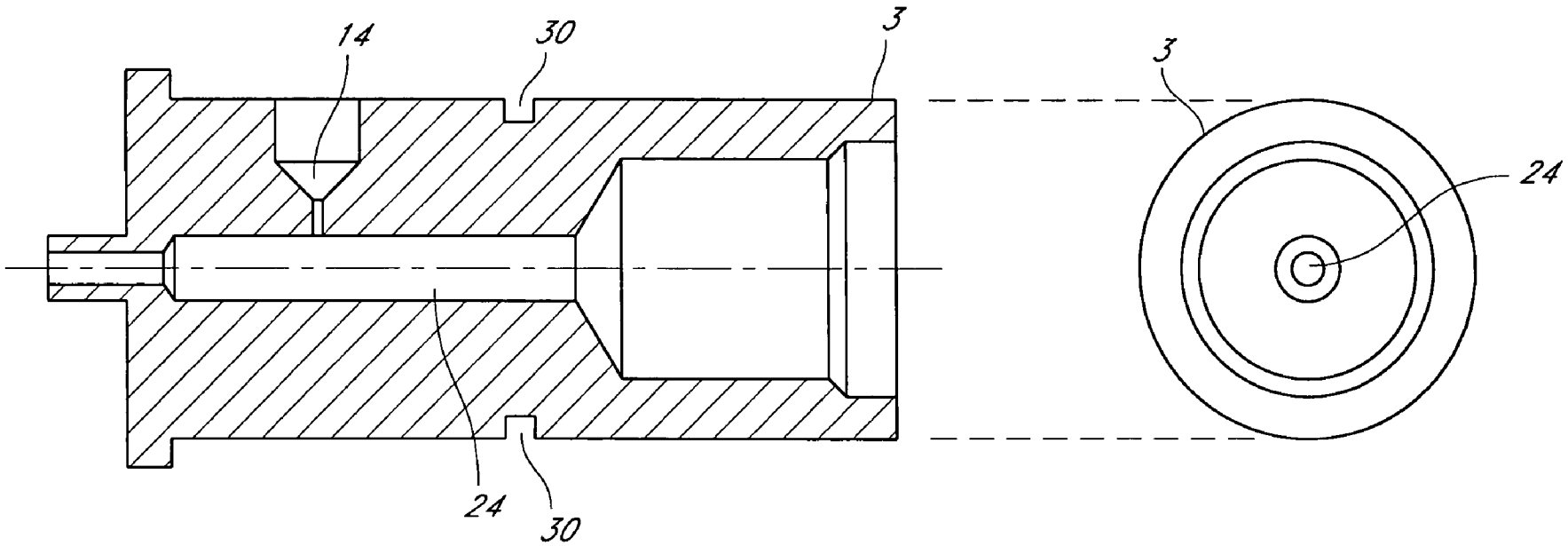
FIG. 10 is a detailed schematic of the swivel fitting shown in FIG. 7, according to an embodiment of the invention.

FIG. 10 is a detailed schematic of the swivel fitting 3 shown in FIG. 7, according to an embodiment of the invention. FIG. 10 illustrates the slot 30 and the fluid passage 24 through the swivel fitting 3. FIG. 10 also shows an approximate representation of the shape and size of the vent 14 through the side of the swivel fitting 3. In an exemplary embodiment, the upper diameter of the vent 14 is approximately 0.25 inches or larger and is configured to receive and to be sealed by the pin shown in FIG. 11.

Figure 11:
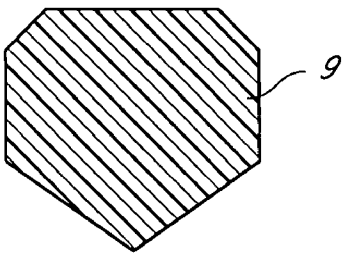
FIG. 11 is a detailed schematic of the pin vent shown in FIG. 7, according to an embodiment of the invention.

FIG. 11 is a cross-sectional (through the center) side view schematic of the pin 9 shown in FIG. 7, according to an embodiment of the invention. The dimensions are in inches and are for exemplary purposes. As shown, the pin 9 is configured and sized so as to be positioned into the vent hole 14 shown in FIG. 10 and to seal the vent hole 14 when pressed into the vent hole 14 by the cam action of the cam ring 5 shown in FIG. 7. Although not shown, a top view of the entire pin 9 (i.e., not a cross-section of the pin 9) shown in FIG. 7 would be circular having a diameter of approximately 0.25 inches. In a preferred embodiment, the pin 9 comprises nylon.

Figure 12:
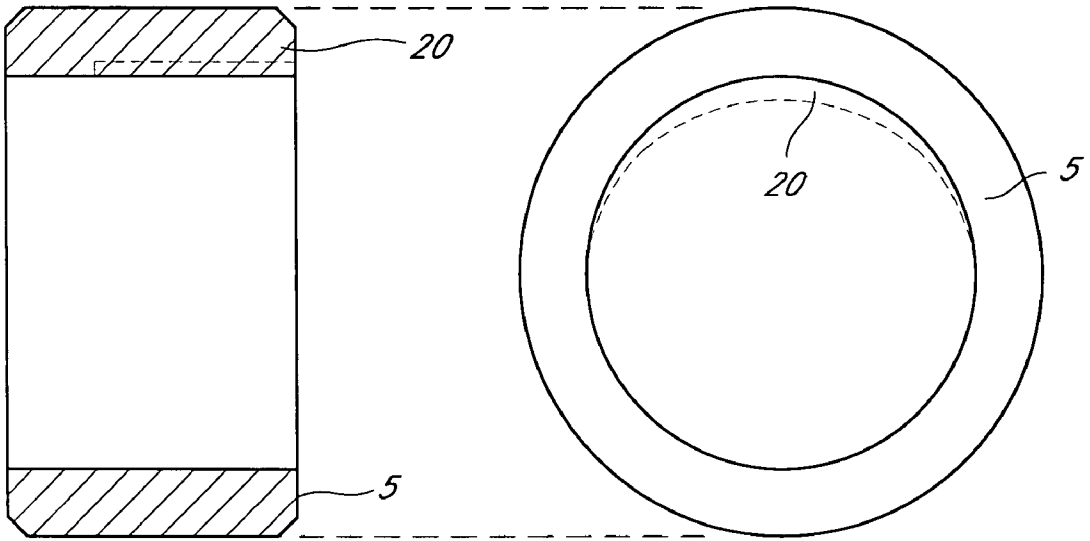
FIG. 12 is a detailed schematic of the cam ring shown in FIG. 7, according to an embodiment of the invention.

FIG. 12 is a detailed schematic of the cam ring 5 shown in FIG. 7, according to an embodiment of the invention. A portion of the inside diameter of the cam ring 5 is removed to form a recessed area 20 configured to fit over the pin 9 shown in FIG. 7. The cam ring 5 can also be formed or molded to create the recessed area 20. The recessed area 20 is tapered or formed in the shape of a "half moon" so as to provide a cam action wherein rotating the cam ring 5 around the swivel fitting 3 presses the pin 9 into the vent 14 shown in FIG. 10 and prevents the fluid (not shown) from passing between the vent 14 and the fluid passage 24.

Figure 13:
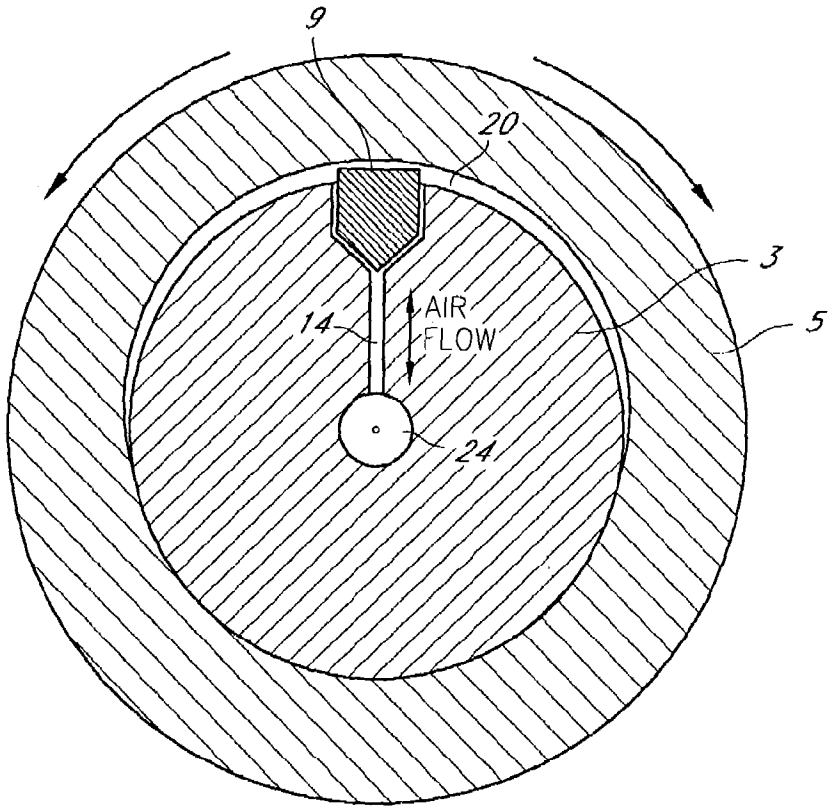
FIG. 13 is a cross-sectional cut view of the swivel fitting shown in FIG. 7 illustrating the cam ring positioned to allow fluid to escape past the pin vent, according to an embodiment of the invention.

FIG. 13 is a cross-sectional cut view of the swivel fitting 3 shown in FIG. 7 illustrating the cam ring 5 positioned around the swivel fitting 3 and over the pin 9 and vent 14. As shown, the recessed area 20 of the cam ring 5 is positioned so as to allow fluid (not shown) flowing in the fluid passage 24 to flow around the pin 9 and out of the vent 14.

Figure 14:
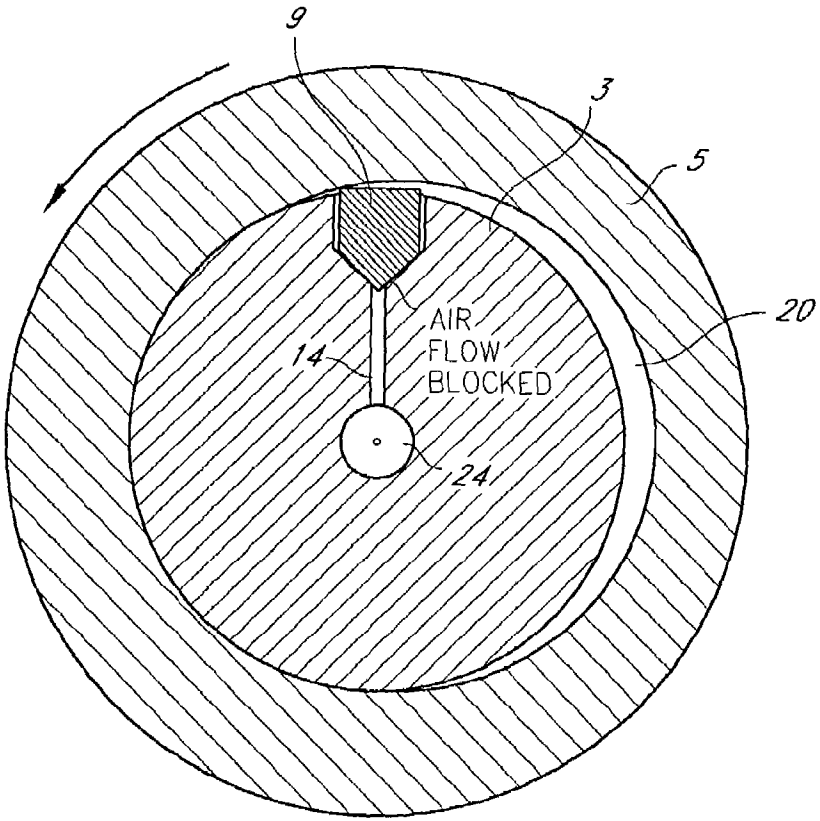
FIG. 14 is a cross-sectional cut view of the swivel fitting shown in FIG. 7 illustrating the cam ring positioned to push down on the pin vent and prevent fluid from flowing out of the vent hole, according to an embodiment of the invention.

FIG. 14 is a cross-sectional cut view of the swivel fitting 3 shown in FIG. 7 illustrating the cam ring 5 positioned around the swivel fitting 3 and over the pin 9 and vent 14. As shown, the recessed area 20 of the cam ring 5 is positioned so as to push down on the pin 9 and prevent fluid flowing in the fluid passage 24 from flowing out of the vent 14.

Although the foregoing invention has been described in terms of certain preferred embodiments, other embodiments will be apparent to those of ordinary skill in the art. Additionally, other combinations, omissions, substitutions and modifications will be apparent to the skilled artisan in view of the disclosure herein. Accordingly, the present invention is not intended to be limited by the reaction of the preferred embodiments, but is to be defined by reference to the appended claims.

What is claimed is:

1. A method for automatically venting a fluid from a pressurized system, the method comprising:

attaching a passage to a pressurized system, wherein the same action which attaches the passage automatically seals a vent;

pressurizing the passage; and detaching the passage from the pressurized system, wherein the act of detaching also automatically unseals the vent.

2. An apparatus for automatically venting a fluid from a pressurized system, the apparatus comprising:

a connector configured to be attached and detached from a pressurized system; and an automatic vent coupled to the connector, the automatic vent configured to automatically close when the connector is attached to the pressurized system and to automatically open as the connector is detached from the pressurized system.

3. The apparatus of claim 2, wherein the automatic vent forms part of the connector.

4. A method for filling a pressurized tank with a fluid using an adapter configured to automatically vent the fluid so the adapter can be safely removed from the pressurized tank, the method comprising:

attaching a connector to a pressurized tank;

filling the pressurized tank through the connector, wherein the act of filling applies pressure to the connector; and detaching the connector from the pressurized tank by actuating the connector, wherein actuating the connector automatically releases the pressure applied to the connector before the connector is detached.

5. The method of claim 4, wherein actuating the connector comprises a cam action to unseal a vent.

6. The method of claim 5, wherein the cam action releases a pin from a vent hole.

7. The method of claim 6, wherein the cam action further detaches the connector by unthreading the connector from the pressurized tank.

8. An adapter assembly comprising:

a fluid passage configured to pass pressurized fluid from a first end of the adapter assembly to a second end of the adapter assembly;

a vent hole communicating with the fluid passage; and a pin configured to automatically seal the vent hole upon attaching the adapter assembly to an exterior device and automatically unsealing the vent hole before detaching the adapter assembly from the exterior device.

9. The adapter assembly of claim 8, further comprising a connector having a cam configured to press the pin into the vent hole when the connector is threaded onto the exterior device and to release the pin when the connector is unthreaded from the exterior device.

10. An adapter to provide a connection between a source of compressible fluid and a tank that needs to be filled with compressible fluid, the adapter comprising:

a fluid passage with a threaded connector at one end to connect with one of the source or the tank;

a ring which surrounds the fluid passage and is aligned with the threaded connector such that rotating the ring in one direction will act to turn the threaded connector into engagement with a mating threaded connector and turning the ring in the other direction will act to release the threaded connector from engagement with the mating threaded connector; and a vent valve which acts to vent the connection when the ring is turned in the release direction and which is sealed when the ring is turned in the engagement direction.

* * * * *